US005584608A

United States Patent [19]

Gillespie

[11] Patent Number: 5,584,608

[45] Date of Patent: Dec. 17, 1996

[54] ANCHORED CABLE SLING SYSTEM

[76] Inventor: Harvey D. Gillespie, 4848 S. 2200 West, Salt Lake City, Utah 84118

[21] Appl. No.: 270,745

[22] Filed: Jul. 5, 1994

[51] Int. Cl.[6] ..... E21D 20/00

[52] U.S. Cl. ..... 405/259.6; 405/302.2

[58] Field of Search ..... 405/259.1, 288, 405/302.2, 259.6

[56] References Cited

U.S. PATENT DOCUMENTS

| | | | |
|---|---|---|---|
| 3,505,824 | 4/1970 | White | 405/302.2 |
| 3,509,726 | 5/1970 | White | 405/302.2 |
| 3,601,994 | 8/1971 | Galis | 405/288 |
| 4,247,225 | 1/1981 | Chickini, Jr. | 405/259.5 |
| 4,265,571 | 5/1981 | Scott | 405/259.3 |
| 4,360,292 | 11/1982 | Keeler | 405/244 |
| 4,679,967 | 7/1987 | Hipkins, Sr. | 405/288 |
| 4,767,242 | 8/1988 | McLaren | 405/288 |
| 4,934,873 | 6/1990 | Calandra, Jr. | 405/288 |
| 4,946,315 | 8/1990 | Chugh | 405/288 |
| 5,193,940 | 3/1993 | Long | 405/259.1 |
| 5,238,329 | 8/1993 | Long | 405/288 |
| 5,259,703 | 11/1993 | Gillespie | 405/259.6 |
| 5,288,176 | 2/1994 | Huff | 405/259.6 |
| 5,378,087 | 1/1995 | Locotos | 405/259.5 |

*Primary Examiner*—David J. Bagnell
*Attorney, Agent, or Firm*—Prince, Yeates & Geldzahler

[57] ABSTRACT

An anchored cable sling system stabilizies and supports the rock formation above a mine tunnel roof. The system comprises a unitary multi-strand cable having a series of anchor collars on each end. The anchor collars include radially extending wings that: (1) cut and shread the resin grout material cartridges, (2) mix the resin grout material as the cable end is being inserted into the mine tunnel roof bore hole, and (3) center the anchor collars and cable in the bore hole. The anchor collars are oriented on the cable so that the wings thoroughly mix the resin grout material as it makes its way down the annulus between the cable and bore hole wall as the cable is being forced into the bore hole. The anchored cable sling system is installed in a mine tunnel roof without the necessity of spinning or rotating the cable ends in order to mix the resin grout material. The system may also include a structural beam support and a post-installation tensioning means.

13 Claims, 6 Drawing Sheets

ANCHORED CABLE SLING SYSTEM

BACKGROUND OF THE INVENTION

1. Field of the Invention

The present invention relates to mine roof support systems, and more particularly relates to a mine roof support system comprising a sling that spans the width of the mine roof and is anchored into the rock formations above and behind each sidewall of a mine tunnel.

2. Description of the Prior Art

Sling support systems for underground mine tunnel roofs have been in existance for some time. Most of the older systems comprise two standard mine roof bolts anchored into the rock formation above the mine tunnel roof adjacent opposite mine tunnel walls at approximately 45° from vertical. Each of these mine roof bolts passes through a connector of some sort that connects to a respective end of a bar or rod that spans the width of the mine tunnel roof. This horizontal rod may be formed in sections, if necessary. The horizontal rod is anchored to the mine roof bolts at each end thereof by a collar or sleeve that permits the horizontal rod to be tensioned as either mine roof bolt is further screwed into its own anchor imbedded in the rock formation above the mine tunnel roof and tunnel wall. This concept is basically shown in U.S. Pat. No. 3,509,726.

Subsequent modifications to this concept are shown in U.S. Pat. No. 4,679,967, which shows a sling bracket that is used at each end of the horizontal support bar. The sling bracket is anchored to the mine roof by a mine roof bolt, again anchored in the rock formation above the mine tunnel roof and tunnel wall. The horizontal span of rod attaches to the sling bracket in a manner to permit the horizontal rod to be tensioned independently of the two anchored mine roof bolts.

U.S. Pat. No. 4,946,315 shows an improvement on the previous design, that being the introduction of a third sling bracket at the approximate mid-point of the span of the horizontal rod, the third bracket being adapted to attach to a vertically oriented mine roof bolt for stabilizing the horizontal span to the rock formation directly above the mine roof.

U.S. Pat. No. 4,934,873 shows a variation on the tensioning of the horizontal sling. U.S. Pat. Nos. 5,193,940 and 5,238,329 both show mine roof sling systems that utilize a different threaded attachment mechanism for attaching the horizontal rod to the mine roof bolts that are anchored at the 45° angle into the rock formation above the mine roof and mine sidwall.

U.S. Pat. No. 4,265,571 shows a mine roof sling system comprising a one-piece cable that is anchored at each end into the rock formation above the mine tunnel roof and the sidewall. This cable sling system includes an anchoring collar at each end of the cable that is driven into the bore hole and retained therein by a split sleeve anchoring tool, which remains in the bore hole to anchor the end of the cable therein. In addition, the cable anchor could comprise an expandable wedge-type anchor, and/or could also be anchored into the bore hole by cement.

Until the introduction of the cable sling, mine roof slinges were constructed of separate horizontal sections (bars, rods, etc.) having plates or connectors at each end thereof that were somehow attached to mine roof bolts that were anchored into the rock formation above the mine roof, as previously described. In these cases, mine roof bolts were necessary because resin grout material was required to anchor the sling via the mine roof bolt into the rock formation. Because the resin grout material was necessary, bolts were required, as opposed to cables, because bolts could be rotated in the bore hole, and rotation of the mine roof bolt was necessary to thoroughly mix the resin grout material in order to effect a suitable anchor of the bolt in the rock formation. Although a single cable sling could be used, there was no way to rotate the ends of the cable as they were being inserted into their respective mine roof bore holes in order to mix the resin grout material. Therefore., the cable sling of U.S. Pat. No. 4,265,571 cannot use the stronger and preferrable resin grout material, but rather must use cement, in combination with the friction shear resistance force between the bore hole and split sleeve anchor. The split sleeve anchors were required because cement alone (which did not require mixing) was insufficient to retain the cable in place. In addition, the split sleeve anchors required special air or hydraulic jacks and associated additional compressors, pumps, hoses,, etc., for installation.

OBJECTS OF THE INVENTION

It is an object of the present invention to provide a unitary piece cable sling system that is anchored at each end into respective bore holes in the mine tunnel roof by the use of stronger resin grout material without having to rotate or spin the end of the cable in the bore hole in order to mix the resin grout material.

It is a further object of the present invention to provide a cable sling system comprising a single piece of multi-strand cable that also includes a mechanism for post-installation tensioning of the cable sling.

It is a further object of the present invention to provide a cable sling system that can be installed in a mine tunnel roof with standard mine tunnel roof bolting equipment.

SUMMARY OF THE INVENTION

The improved anchored cable sling system of the present invention comprises a unitary piece of multi-strand steel cable. Each end of the cable includes a plurality of steel anchor collars swaged concentricly onto the cable in order to prevent axial movement of the cable within the bore hole. Each of these collars includes a plurality of wings extending radially from the center of the cable. These collar wings are multi-functional. Initially, the collar wings are formed with sharp edges that readily cut into and shred the plastic resin grout material cartridges placed in the end of the bore hole ahead of the cable end. Secondly, the wings serve to center the anchor collars and cable within the bore hole to permit the resin grouting material to flow evenly around the collars as the cable is inserted into the bore hole. Thirdly, the collars are oriented on the cable with the wings alternately directed on successive collars in order that the wings thoroughly mix the resin grout material as it is forced around the collars and along the annulus around the cable, as the cable end is inserted into the bore hole. In addition, the collars are spaced along the cable sufficiently closely that the resin grout material being forced around the series of collars on the cable is thoroughly mixed in order to adhere to the cable and the bore hole wall. With the resin grout material totally surrounding the plurality of anchor collars, the resin grout material will more effectively retain the anchor collars, and therefore the cable itself, securely anchored to the wall of the bore hole.

In a second embodiment, a structural beam is placed directly above the horizontal span of cable, between the cable and the mine tunnel roof, the cable, of course, retaining the structural beam in position to support the rock formation above the structural beam. This embodiment may also include a tensioning device for the cable span, the tensioning device comprising a screw-jack mechanism between the cable span and the structural beam, both for imparting additional tension to the cable sling and for imparting an upward force to the mine tunnel roof to support the rock formation thereabove.

DESCRIPTION OF THE PREFERRED EMBODIMENT

Figure 1:
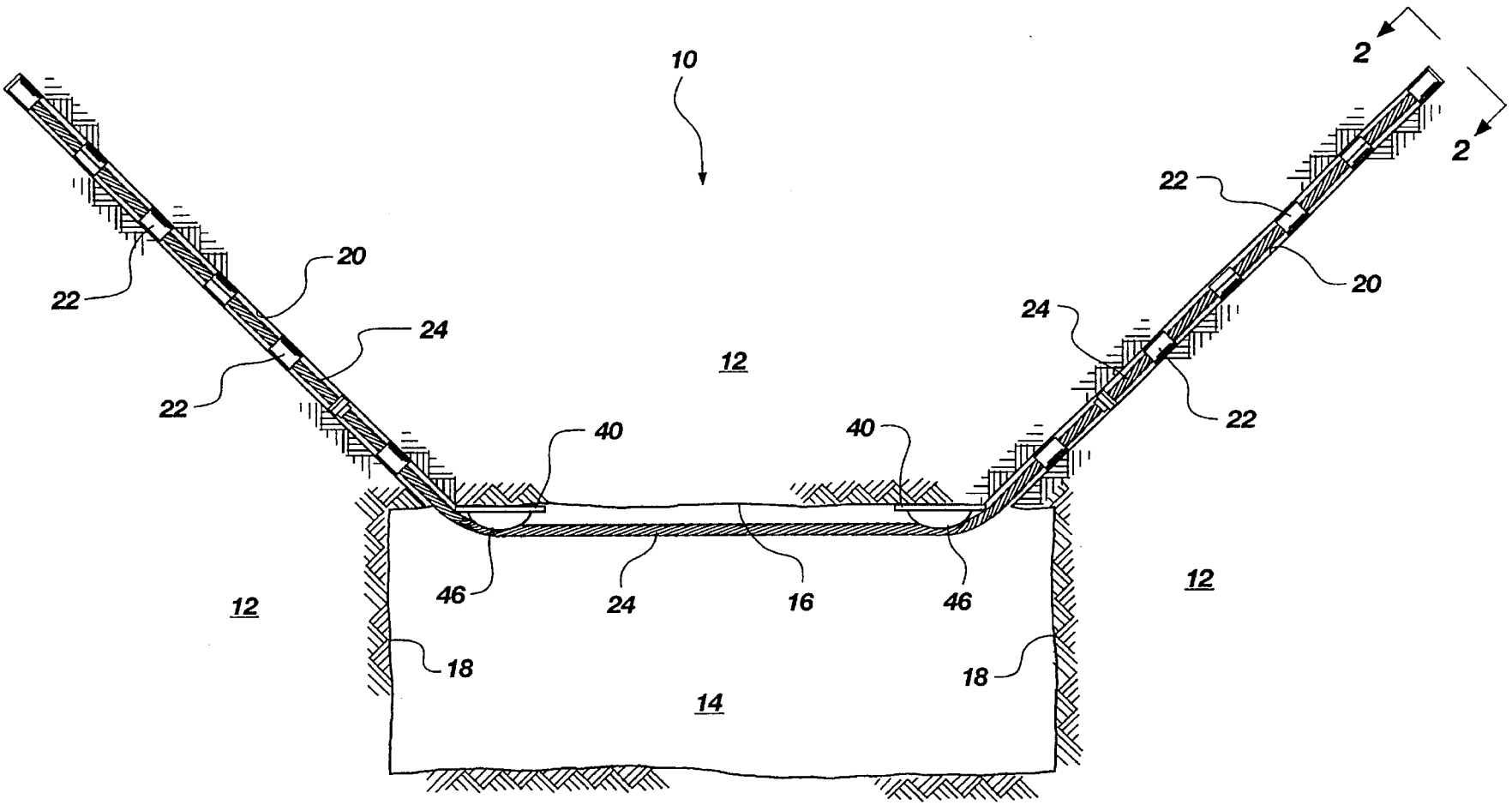
FIG. 1 is a side elevation of a typical mine tunnel showing the anchored cable sling system of the present invention installed in the roof thereof.

Referring now to the drawings, and initially to FIG. 1, the anchored cable sling system of the present invention is shown generally illustrated by the numeral 10. The cable sling system is shown anchored in position within the rock formation 12 directly above a mine tunnel 14. The mine tunnel includes a roof 16 and sidewalls 18. As shown, bore holes 20 are bored into the mine tunnel roof 16 adjacent respective sidewalls 18, and at angles approximating 45° from vertical or horizontal in order that the hole is actually bored into the rock formation above and behind the mine tunnel sidewalls 18.

The anchored cable sling system 10 includes right and left ends, as shown in FIG. 1. Inasmuch as the elements of both ends of the cable sling are identical, they will be indicated by like reference numerals. As shown, each end of the cable sling includes a plurality of anchor collars 22 attached to the cable at various points. These anchor collars 22 take the form of steel sleeves or cylinders that are swaged down upon the cable 24 with sufficient force to deform the sleeve material into the interstices between the individual peripheral steel strands of the multi-strand cable in order to more securely attach the anchor collar to the cable against axial slippage.

Figure 2:
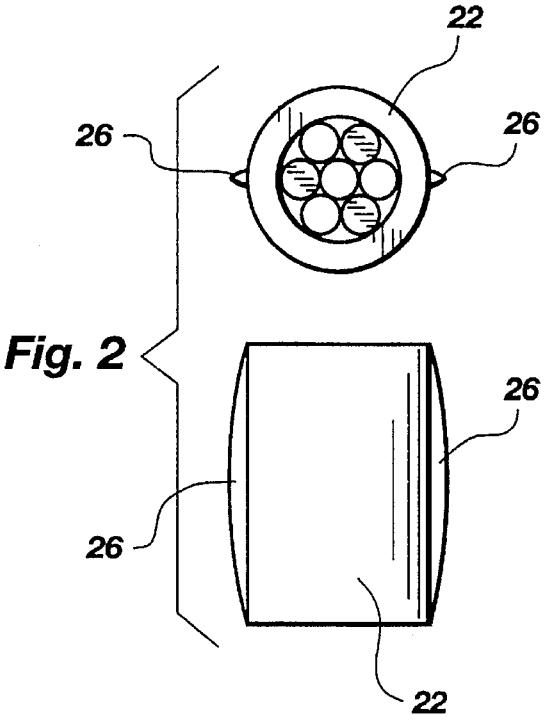
FIG. 2 shows the anchor collar as swaged on the cable.

The steel cylinder that becomes the anchor collar 22 is swaged onto the cable by a piston-ram swaging device (not shown). The swaging device has a stationary semi-cylindrical die, and an opposing semi-cylindrical die mounted on the ram piston for swaging the cylinder onto the cable in diametrical fashion. As a practical matter, the two semi-cylindrical dies are not 100% completely semi-cylindrical. The result is that, when the steel cylinder is swaged onto the cable, swaging causes some of the cylinder material to be forced radially outwardly between the dies, forming two diametrically aligned wings 26 that function as centering devices to center the anchor collars and cable sling within the bore hole. The anchor collar and wings are best shown in FIG. 2.

The pre-swaging diameter of the steel cylinder that becomes an anchor collar 22 is sized to result in the formed anchor collar wings 26 being of a diammetric distance that corresponds to the inside diameter of the mine roof bore hole. In addition, and as best shown in FIG. 2, the formed wings 26 have curved outer surfaces from top to bottom, and have inherently sharp outside cutting edges for cutting into and shredding the plastic casing of the resin grout material cartridge as the end of the cable sling is inserted up into the mine roof bore hole against the grout material cartridge.

Figure 3:
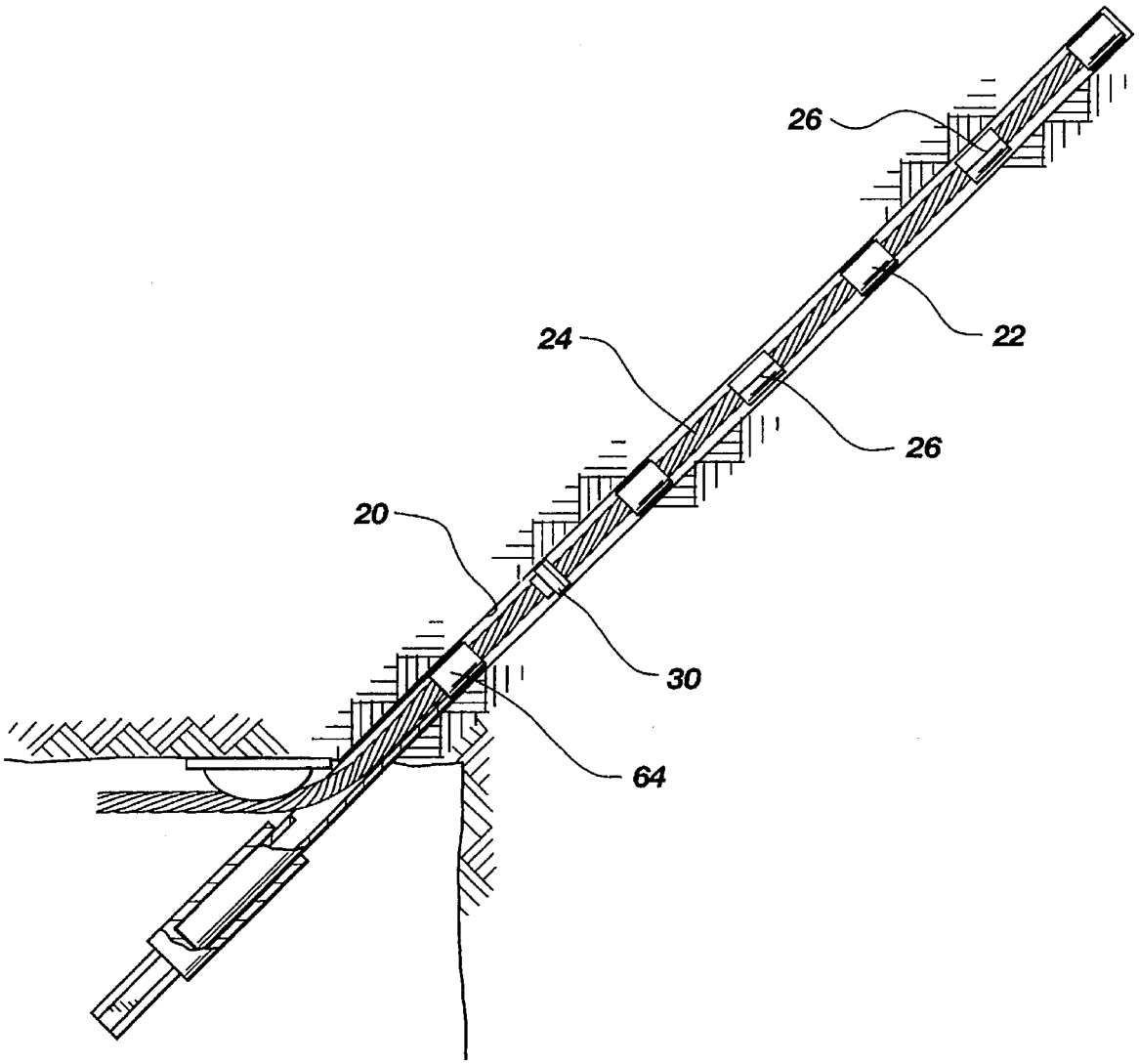
FIG. 3 is a vertical sectional view of one end of the sling cable, illustrating the manner in which the end of the cable is installed and anchored in the bore hole.

As best shown in FIG. 3, each end of the cable sling includes a plurality of anchor collars 22 for anchoring the end of the cable in the bore hole. In a preferred embodiment, each end of the cable includes at least five anchor collars spaced approximately eight inches apart along the cable. In accordance with a primary aspect of the invention, each anchor collar 22 is rotated approximately 90° from the adjacent anchor collars. This orientation serves the multiple purposes of (1) optimizing the function of the anchoring collars to center the cable end within the bore hole, (2) improved cutting and shredding of the resin grout material plastic cartridge bag as the cable end is inserted up into the mine tunnel roof bore hole against the resin cartridge, and (3) optimizing the mixing of the resin grout material as it is forced into the annulus between the mine tunnel roof bore hole and the series of anchor collars, and into the annulus between the mine tunnel roof bore hole and the sections of cable between adjacent anchor collars. The inventor has determined that the combination of the plurality of anchor collars 22 at the relative close spacing thereof and the alternating orientation of the anchor collar wings 26 mixes the resin grout material sufficiently thoroughly that rotating or spinning of the cable within the bore hole is not necessary. Therefore, a single, continuous cable can be used for the sling system, and can be anchored in the rock formation above the mine tunnel using the much stronger resin grout material, as opposed to previous sling systems that comprise separate mine roof bolts necessary for individually and independently spinning within the bore hole to mix the resin grout material, and as opposed to previous cable sling systems that must utilize weaker no-mix cement and split sleeve anchors.

Referring again to FIG. 3, a yieldable grout compactor 30 is positioned on the cable at each end below the plurality of anchor collars 22. This yieldable grout compactor is of a diameter slightly smaller than the bore hole diameter so that it will ride up into the bore hole as the cable end is inserted into the bore hole. The yieldable grout compactor, of course, functions to dam the flow of resin grout material down the bore hole, in order to (1) compact the resin grout material into the top portion of the bore hole and around the anchor collars 26, (2) force all of the air out of the resin grout material, and (3) prevent the resin grout material from seeping down the bore hole wall and away from contact with the cable itself.

Figure 4:
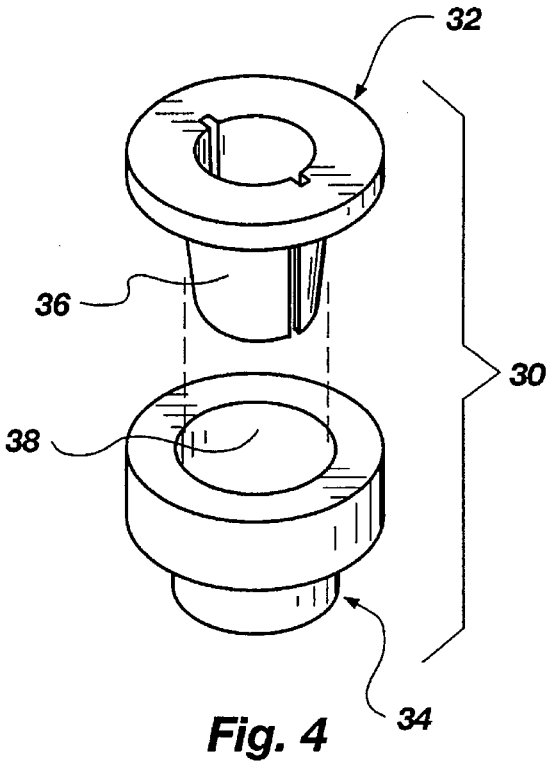
FIG. 4 is a perspective view of the yieldable grout compactor for positioning on the multi-strand cable.

As is best shown in FIG. 4, the yieldable grout compactor 30 comprises two annular sections 32 and 34. The upper annular section 32 includes a split cone 36 that is adapted to fit around the cable (not shown) and into the interior of a funnel-shape surface 38 within the lower compactor annular section 34. In the preferred embodiment, the yieldable grout compactor 30 is constructed of a plastic material, and is intended to slide along the cable surface with a predetermined amount of frictional resistance force. As can be appreciated, the two annular sections of the yieldable grout compactor are installed separately onto the cable, and then positioned together approximately four to five feet from the cable end. When the upper annular section 32 is inserted into the lower annular section 34, the split cone 36 is urged against the surface of the cable 24 to increase the frictional sliding resistance of the compactor on the cable.

As the cable is inserted into the bore hole, the mixture of resin grout material that is being forced down the bore hole through the annulus around the anchor collars and cable is forced down against the top portion 32 of the compactor, and causes the compactor to slide downwardly on the cable, against the frictional resistance force between the internal bore of the yieldable grout compactor and the outer surface of the cable. As can be appreciated, the force of the resin grout material above the yieldable grout compactor 30, being pressurized under the force of the end of the cable being forced into the bore hole, evacuates all of the air from within the annulus in the bore hole around the cable and anchor collars, around the yieldable grout compactor and down the bore hole. Because the yieldable grout compactor 30 is sized to be a diameter slightly less than the inside diameter of the bore hole, the resin grout material will not be forced around the grout compactor, but rather will force the grout compactor to slide downwardly on the cable, thereby compacting the resin grout material above the compactor and preventing the resin grout material from seeping around the compactor and down the bore hole wall. In this manner, the resin grout material is maintained in continuous and uniform contact with both the inside of the bore hole wall and the outer surfaces of the cable and anchor collars in order to optimize the adhesion therebetween to retain the end of the sling cable in functional position within the bore hole.

Figure 5:
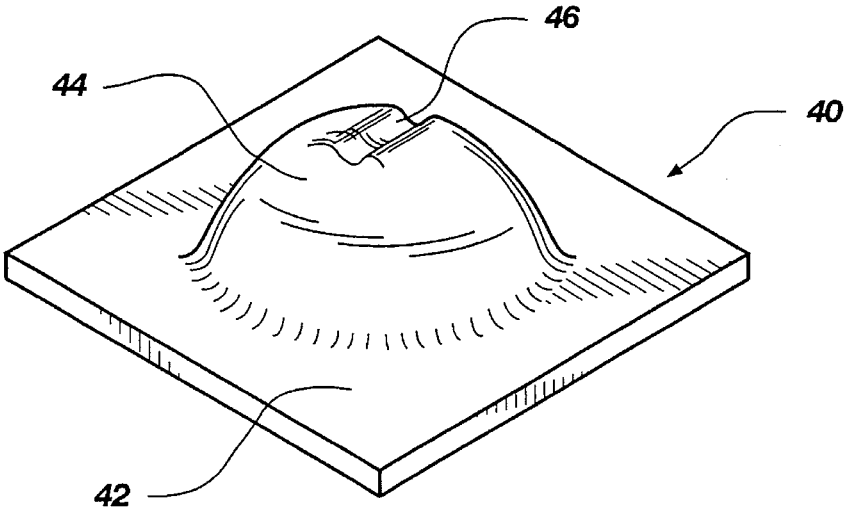
FIG. 5 is a perspective view of a modified roof plate used in the anchored cable sling system of the present invention.

FIG. 5 illustrates a modified roof plate 40 used in the anchored cable sling system of the present invention. The modified roof plate 40 incorporates the conventional flat section 42 and domed section 44. The domed section may or may not include a through hole (not shown) sometimes formed when the domed section 44 is formed in the punch-press. Rather, the modified roof plate 40 includes an open partial cylindrical channel 46. This channel 46 is also open at each end, and is adapted to receive the sling cable 24 therein in a manner to retain the roof plate in functional position against the mine tunnel roof, as will be explained in greater detail hereinbelow.

Referring again to FIG. 1, the anchored cable sling system of the present invention utilizes at least two modified roof plates 40, one being positioned adjacent the opening of each bore hole 20 into the rock formation. The modified roof plates 40 are positioned against the mine tunnel roof in the customary orientation, that being reversed from the orientation shown in FIG. 5. Specifically, the flat section 42 of the mine roof plate is positioned against the mine tunnel roof, with the open partial cylindrical channel 46 being positioned over the anchor cable 24, adjacent the bore hole opening 20. The purpose of the so-positioned mine roof plate is to eliminate or at least minimize deformation and destruction of the rock formation 12 immediately adjacent and above the opening of the bore hole, and to prevent the cable from cutting into the mine tunnel roof. Those skilled in the art will readily appreciate that, without the modified roof plates 40 being so positioned, the tensioned sling cable would cut into the rock formation, thereby releasing the tension thereon, rendering essentially ineffective the anchored cable sling system.

Figure 6:
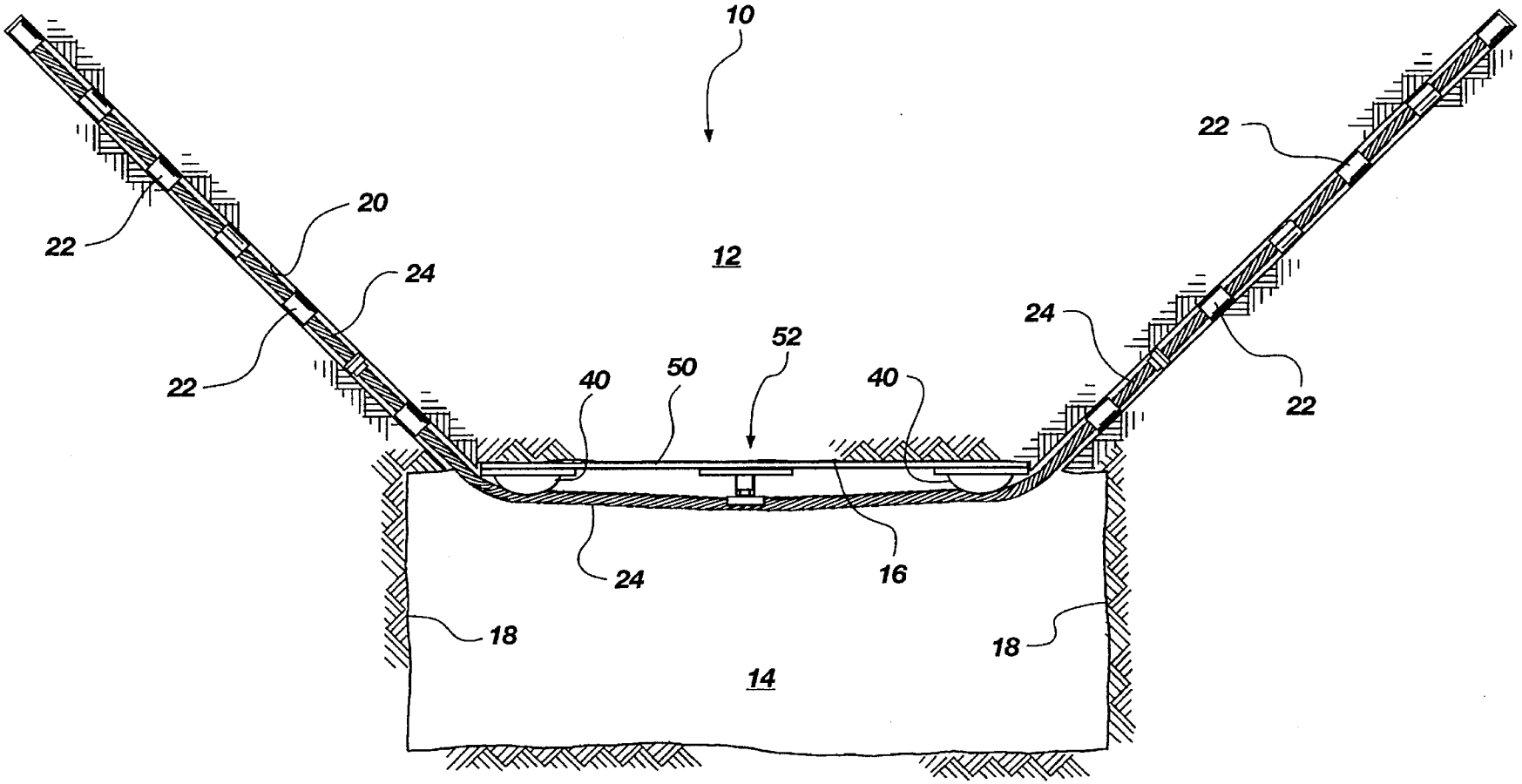
FIG. 6 is a side elevation of the mine roof cable sling system installed in a mine roof, also illustrating the mine roof structural beam and tensioning mechanism.

FIG. 6 illustrates an alternative embodiment of the anchored cable sling system of the present invention. This alternative embodiment comprises the single sling cable, as in the first embodiment illustrated in FIG. 1, but with the addition of two additional elements. The alternative embodiment of FIG. 6 includes a roof structural beam 50 positioned directly against the mine tunnel roof rock formation, and between the mine roof and the modified roof plates 40. The roof structural beam 50, of course, supplements the anchored cable sling system in supporting the rock formation 12 above the mine tunnel.

The roof structural beam 50 takes the form of a conventional structural beam that is conventionally used in conjunction with a plurality of vertically oriented mine roof bolts that have been resin grouted into vertical bore holes in the rock formation directly above mine tunnels, in a customary manner. In this embodiment, however, the roof structural beam 50 is not "bolted" to the mine roof, but rather is held in place by the lateral force of the sling cable 24 acting directly against the modified mine roof plates 40. This lateral force from the cable 24 acts normally against the mine roof, through the mine roof plates 40 and roof structural beam 50. The roof structural beam 50, of course, functions to support the rock formation 12 directly above the mine tunnel.

Frequently the rock formations directly above mine tunnels shift, resulting in substantial sag of the mine tunnel roof into the tunnel interior. In these instances, the roof structural beam 50 is advantageous in preventing a certain amount of rock formation sag. Nonetheless, it is recommended to minimize this mine roof sag as much as possible, in order to avoid collapse of the rock formation directly above the mine tunnel.

The second embodiment of the anchored cable sling system of the present invention functions to minimize this rock formation sag, and otherwise to maintain the rock formation above the mine tunnel roof fully supported against collapse. To this end, the second embodiment includes a manually adjustable cable span tensioning mechanism, generally illustrated at 52. As shown in FIG. 6, this tensioning mechanism 52 is positioned at the approximate mid-point of the cable span, between the cable and the roof structural beam 50, and functions to vertically support the rock formation directly above the sling system cable and roof structural beam.

Figure 7:
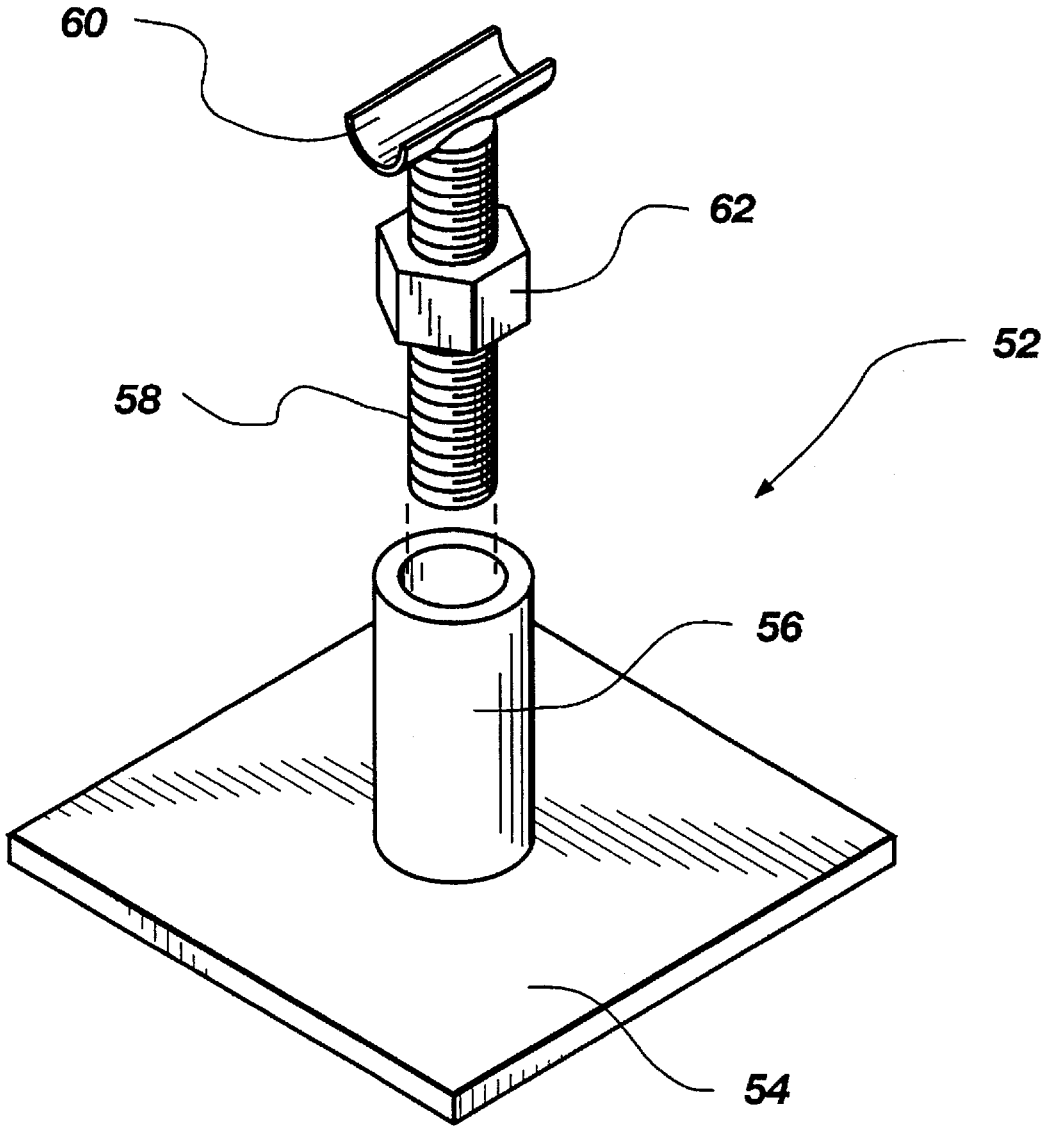
FIG. 7 is a perspective view of the cable span tensioning mechanism.

FIG. 7 is a perspective view of the cable span tensioning mechanism. The tensioning mechanism takes the form of a screw-type jack and comprises a plate 54 to which is affixed a cylinder 56. The cylinder is adapted to rotatably receive therein a threaded rod 58 having a cable saddle 60 formed therewith. Tensioning is effected by the tensioning mechanism by telescopic extension of the threaded rod 58 from the cylinder 56. A standard hex nut 62 effects this telescopic extension of the threaded rod from the cylinder 50.

Returning to FIG. 6, those skilled in, the art will readily appreciate that the cable span tensioning mechanism 52 is positioned above the cable 24 and between the cable and roof structural beam 50. Additionally, the cable span tensioning mechanism is oriented upside down from the way it is depicted in FIG. 7. Specifically, the plate 54 is positioned against the roof structural beam 50, with the threaded rod 58 pointed downwardly in order that the cable saddle 60 will engage the top surface of the sling cable 24.

From time to time, the rock formation above the mine tunnel will shift, occasionally causing the anchored cable sling system to lose its tension in the cable 24. When this happens, the cable sling system ceases to function as effectively to hold the rock formation in place. At other times, shifting of the rock formation directly above the mine tunnel will cause the mine roof to sag, generally in its area of non-support, that area directly above the mine roof. In either of these instances, it is imperative that the cable sling system be post-tensioned in order to: (1) retension the sling cable to recompress the rock formation, (2) raise the sagging rock formation directly above the mine tunnel roof, or at least prevent it from sagging further, or (3) both retension the sling cable and prevent further sagging of the mine tunnel roof. The cable sling system of the present invention accomplishes this post-tensioning by means of the cable span tensioning mechanism shown in FIG. 7. Those skilled in the art will appreciate that, by simply rotating the standard hex nut 62, the threaded rod 58 will telescopically extend from the tensioning mechanism cylinder 56 against the sling cable 24. This extension of the tensioning mechanism induces a compressive force against the mine tunnel roof, and therefore the rock formation thereabove, and against the horizontal span of sling cable 24, thereby re-tightening any tension in the cable that has been lost due to shifts in the rock formation. This compressive force against the mine tunnel roof, of course, eliminates, or at least minimizes, any further sag in the mine roof. In addition, this post-tensioning of the sling cable creates additional transverse (horizontal) compressive forces within the rock formation directly above the mine tunnel roof to further stabilize the rock formation against further shifting.

FIG. 6 illustrates the location of a single cable span tensioning mechanism 52 in the approximate mid-point of the span between the mine roof bore holes 20. It should be obvious that a number of such cable span tensioning mechanisms 52 could be used along the horizontal cable span, as desired, in order to effect the intended purpose, specifically to prevent further sag of the mine tunnel roof due to shifting in the rock formation above, and specifically to provide additional locations of desired upward compressive force against the mine tunnel roof to support it against potential collapse.

INSTALLATION

Returning to FIG. 3, each end of the cable includes a insertion collar 64 to enable each end of the cable to be pushed up into the bore hole 20. As in the anchor collars 22, the insertion collar 64 comprises a steel cylinder that is swaged onto the cable by a piston-ram swaging device. Unlike the anchor collars 22, however, the insertion collars 64 do not include the multi-purpose diametrical wings. Rather, the insertion collar 64 includes a cylindrical outer surface that is sized to be slightly less than the interior diameter of the bore hole, approximately that of the yieldable grout compactor 30. The insertion collar 64 is not intended to be resin grouted into the bore hole, in that, the insertion collar is below the yieldable grout compactor 30, and therefore, does not necessarily ever come in contact with the resin grout material. Rather, the insertion collar 64 is used solely as a means for inserting each end of the sling cable into its respective bore hole, and for maintaining tension on the sling cable until the resin grout material has set within the annulus around the sling cable end and anchor collars 22.

Figure 8:
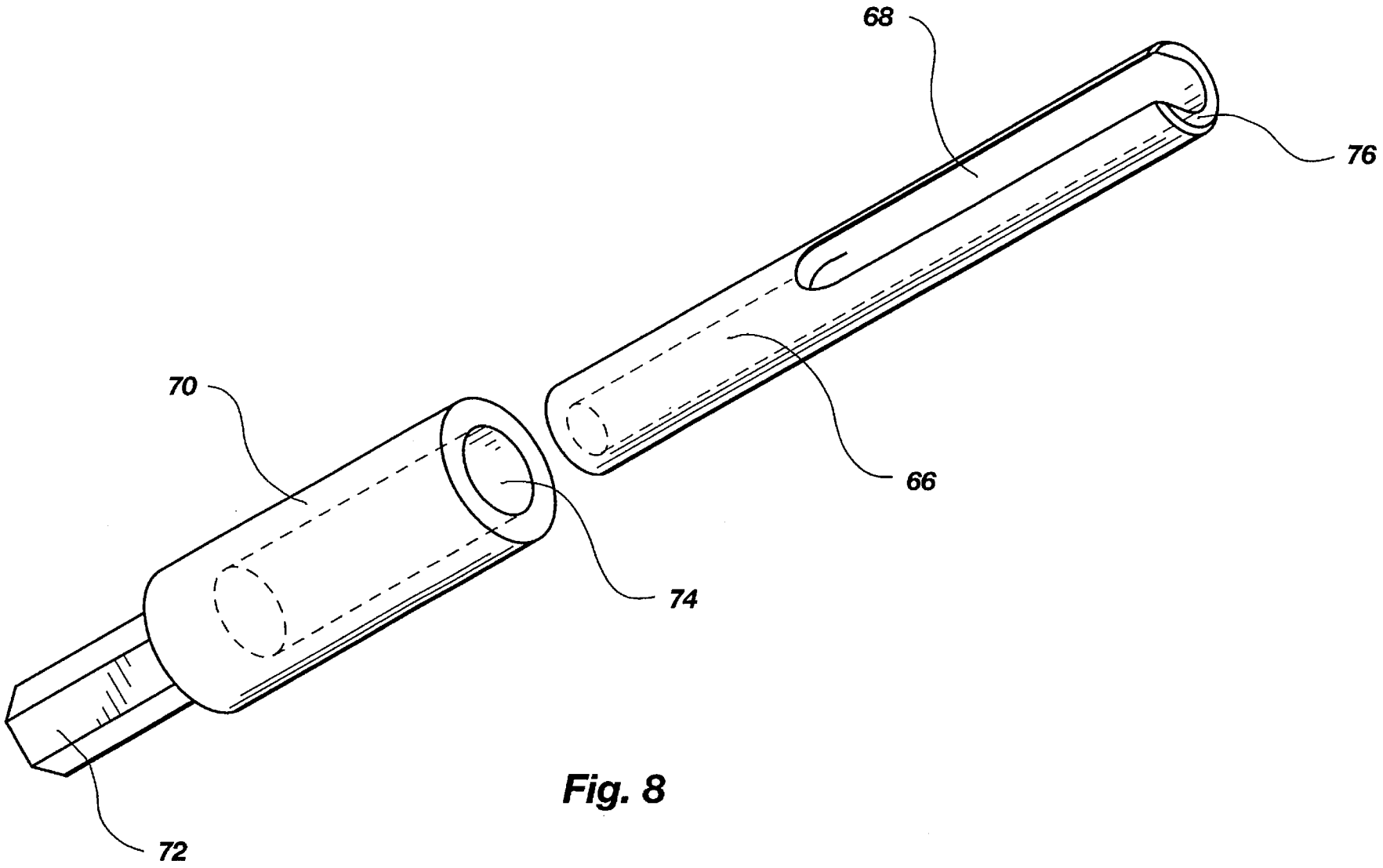
FIG. 8 is a perspective view of the installation tool for the cable sling system.

FIG. 8 illustrates a tool for installing the cable sling system in a mine tunnel roof, and specifically for inserting each end of the sling cable into its respective bore hole and maintaining tension on the sling cable until the resin grout material sets. The cable sling installation tool comprises a pipe section 66 having a longitudinal slot 68 formed therein. The pipe section 66 is adapted to rotatably fit into a receptacle 70 having a square or hexagonal shaped base 72 adapted to fit into the boom of a conventional roof bolter (not shown) for providing the axial force to insert the end of the cable into the bore hole, and for maintaining the axial tension on the sling cable in the bore hole until the resin grout material sets around the cable. The receptacle 70 includes a blind bore 74 for receiving the pipe section 66 therein in a manner that the pipe section may freely rotate within the receptacle.

The installation tool of FIG. 8 is utilized to enable a conventional mine roof bolting machine to install the cable sling system of the present invention. As can be appreciated, the cable 24 below the insertion collar 64 (See FIG. 3) is inserted into the longitudinal slot 68 of the pipe section 66, so that the end surface 76 of the pipe section urges against the bottom surface of the insertion collar. The longitudinal slot 68 in the pipe section is sufficiently long to permit a considerable length of the cable 24 to "nest" therein as the end of the cable is inserted into the mine tunnel roof bore hole. With the pipe section 66 rotatably inserted into the blind bore 74, the square or hexagonal base 72 is fitted into the bolt head receptacle of a standard mine roof bolting machine boom (not shown). The bolting machine provides the axial force to force the end of the cable sling system into the mine roof bore hole, and retain the end of the cable sling system in the bore hole until the resin grout material sets, in the customary manner.

In the event that the roof bolting machine operator inadvertently causes the boom to rotate as it is inserting one or both ends of the cable into the bore hole(s), the rotational connection of the pipe section 66 within the blind bore 74 will permit the receptacle 70 to freely rotate relative to the pipe section, while the pipe section remains stationary (non-rotating) as axial force from the roof bolting maching urges or maintains the end of the cable in the mine roof bore hole. In this manner, a conventional roof bolting machine may be used to install the anchored cable sling system of the present invention, without the additional requirement for special air or hydraulic jacks and associated compressors, pumps, hoses, etc.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. An anchored cable sling system for supporting a mine tunnel roof, comprising:

a length of multi-strand cable;

a first anchor collar permanently attached to said cable adjacent a first end for preventing said cable from slipping relative to resin adhesive material surrounding said first anchor collar within a first bore hole in the mine roof; and a second anchor collar permanently attached to said cable adjacent the second end for preventing said cable from slipping relative to resin adhesive material surrounding said second anchor collar within a second bore hole in the mine roof.

2. An anchored cable sling system as set forth in claim 1, further comprising a plurality of anchor collars permanently attached adjacent each end of said cable.

3. An anchored cable sling system as set forth in claim 1, wherein said anchor collar includes radially outwardly projecting wings oriented axially relative to said collar for centering said collar and said cable within the bore hole, for puncturing resin adhesive cartridges, and for mixing the resin adhesive material.

4. An anchored cable sling system as set forth in claim 3, wherein said anchor collar is cylindrical, and wherein said wings are oriented across the diameter of said collar.

5. An anchored cable sling system as set forth in claim 1, further comprising a roof plate for positioning adjacent the mine tunnel roof, and wherein said cable urges said roof plate against the mine tunnel roof.

6. An anchored cable sling system for supporting a mine tunnel roof, comprising:

a length of multi-strand cable;

a plurality of first anchor collars permanently attached to said cable adjacent a first end for preventing said cable from slipping relative to resin adhesive material within a first bore hole in the mine roof;

a plurality of second anchor collars permanently attached to said cable adjacent the second end for preventing said cable from slipping relative to resin adhesive material within a second bore hole in the mine roof; and first and second cable insertion collars permanently attached to said cable in spaced relation to respective first and second anchor collars.

7. An anchored cable sling system as set forth in claim 6, wherein each of said anchor collars includes radially outwardly projecting wings oriented axially relative to said collars for centering said collars and said cable within the bore hole, for puncturing resin adhesive cartridges, and for mixing the resin adhesive material.

8. An anchored cable sling system as set forth in claim 7, wherein each of said anchor collars is cylindrical, and wherein said wings are oriented across the diameter of said collars.

9. An anchored cable sling system for supporting a mine tunnel roof, comprising:

a length of multi-strand cable;

a plurality of first anchor collars permanently attached to said cable adjacent a first end for preventing said cable from slipping relative to resin adhesive material within a first bore hole in the mine roof;

a plurality of second anchor collars permanently attached to said cable adjacent the second end for preventing said cable from slipping relative to resin adhesive material within a second bore hole in the mine roof;

first and second cable insertion collars permanently attached to said cable in spaced relation to respective first and second anchor collars;

a pair of roof plates for positioning adjacent the mine tunnel roof;

a mine tunnel roof structural beam positioned between the mine tunnel roof and said roof plate; and cable tensioning means for positioning between said cable and said roof structural beam for post-installation tensioning of said cable.

10. An anchored cable sling system for supporting a mine tunnel roof, comprising:

a length of multi-strand cable;

a first anchor collar permanently attached to said cable adjacent a first end for preventing said cable from slipping relative to resin adhesive material within a first bore hole in the mine roof;

a first cable insertion collar permanently attached to said cable in spaced relation to said first anchor collar;

a second anchor collar permanently attached to said cable adjacent the second end for preventing said cable from slipping relative to resin adhesive material within a second bore hole in the mine roof; and a second cable insertion collar permanently attached to said cable in spaced relation to said second anchor collar.

11. An anchored cable sling system for supporting a mine tunnel roof, comprising:

a length of multi-strand cable;

a first anchor collar permanently attached to said cable adjacent a first end for preventing said cable from slipping relative to resin adhesive material within a first bore hole in the mine roof;

a second anchor collar permanently attached to said cable adjacent the second end for preventing said cable from slipping relative to resin adhesive material within a second bore hole in the mine roof;

a roof plate for positioning adjacent the mine tunnel roof, and wherein said cable urges said roof plate against the mine tunnel roof; and cable tensioning means for positioning between said cable and said mine tunnel roof for post-installation tensioning of said cable.

12. An anchored cable sling system as set forth in claim 11, further comprising a mine tunnel roof structural beam positioned between the mine tunnel roof and said roof plate.

13. An anchored cable sling system as set forth in claim 12, further comprising cable tensioning means for positioning between said cable and said roof structural beam for post-installation tensioning of said cable.

* * * * *